US005617695A

United States Patent [19]

Brimmer

[11] Patent Number: 5,617,695

[45] Date of Patent: Apr. 8, 1997

[54] THERMALLY INSULATED COMPOSITE FRAME MEMBER AND METHOD FOR THE MANUFACTURE THEREOF

[76] Inventor: William B. Brimmer, 1238 Valley Hill Trail, Southampton, Pa. 18966

[21] Appl. No.: 380,700

[22] Filed: Jan. 30, 1995

Related U.S. Application Data

[63] Continuation-in-part of Ser. No. 199,999, Feb. 22, 1994, abandoned.

[51] Int. Cl.[6] ..... E06B 3/263

[52] U.S. Cl. ..... 52/717.02; 52/717.05; 52/730.6; 52/204.5; 52/204.71; 49/DIG. 1; 49/DIG. 2

[58] Field of Search ..... 52/717.01, 717.02, 52/717.03, 717.04, 717.05, 717.06, 716.2, 730.3, 730.4, 730.5, 730.6, 734.1, 734.2, 786.1, 204.5, 204.62, 204.71, 204.705; 49/DIG. 1, DIG. 2

[56] References Cited

U.S. PATENT DOCUMENTS

| | | | |
|---|---|---|---|
| 2,589,064 | 3/1952 | Drake | 52/786.1 |
| 2,622,710 | 12/1952 | Haas | 52/730.5 |
| 2,708,774 | 5/1955 | Seelen | 52/786.1 X |
| 2,872,713 | 2/1959 | Haas | 52/786.1 X |
| 3,008,197 | 11/1961 | Trzyna et al. | 52/786.1 X |
| 3,037,589 | 6/1962 | Cole | 49/DIG. 1 X |
| 3,099,337 | 7/1963 | Hetman | 49/DIG. 1 X |
| 3,289,377 | 12/1966 | Hetman | 49/DIG. 1 X |
| 3,335,524 | 8/1967 | Carson | 52/717.02 X |
| 3,436,884 | 4/1969 | Bell et al. | 49/DIG. 1 X |
| 3,564,773 | 2/1971 | Bonnaud | 49/496.1 X |
| 3,925,953 | 12/1975 | Laborde | 49/DIG. 1 X |
| 4,018,022 | 4/1977 | Fink | 52/730.6 X |
| 4,067,163 | 1/1978 | Hetman | 49/DIG. 1 X |
| 4,245,384 | 1/1981 | Egerer | 49/DIG. 1 X |
| 4,377,926 | 3/1983 | Coulston et al. | 49/DIG. 1 X |
| 4,423,578 | 1/1984 | Meigs et al. | 49/DIG. 1 X |
| 4,594,831 | 6/1986 | Winyard | 49/DIG. 1 X |
| 5,058,351 | 10/1991 | Dunstan | 49/DIG. 1 X |

FOREIGN PATENT DOCUMENTS

| | | | |
|---|---|---|---|
| 114221 | 6/1969 | Denmark | 49/DIG. 1 |
| 420567 | 3/1967 | Sweden | 49/DIG. 1 |

*Primary Examiner*—Carl D. Friedman
*Assistant Examiner*—Laura A. Saladino

[57] ABSTRACT

A composite thermally insulated architectural frame member is provided which is comprised first metal section, a second metal section and a preformed thermal break section. The first metal section has a longitudinal inner channel. The second metal section has an extension positioned within the channel of the first section in a predetermined spaced apart relationship from the first metal section. The second metal section is positioned in a longitudinal channel in the thermal break section in a spaced apart relationship from the first metal section. The composite metal frame member is assembled by inserting the thermal break section laterally into the channel of the first metal frame section and then inserting the second metal frame section laterally the channel in the thermal break section. The dimensions of the respective sections are selected so the sections snap lock together.

9 Claims, 3 Drawing Sheets

THERMALLY INSULATED COMPOSITE FRAME MEMBER AND METHOD FOR THE MANUFACTURE THEREOF

CROSS REFERENCE TO RELATED APPLICATION

This is a continuation in part of patent application Ser. No. 08/199,999 of William B. Brimmer filed Feb. 22, 1994, now abandoned.

BACKGROUND OF THE INVENTION

1. Field of the Invention

This invention relates to a composite, thermally insulated architectural frame member. More particularly this invention is concerned with metal windows, doors and the like having an exterior metal frame sections and an interior metal frame section which are thermally insulated from each other by a thermal break section between the exterior and interior frame sections.

2. Description of the Prior Art

Metal building units such windows and doors are widely used in construction and the use is increasing because of the consistent performance, low maintenance and excellent durability.

In the manufacture of the metal building units there are a number of important factors to be considered. The first is the ease of manufacture. Metal windows and doors to a large extent are manufactured on a custom or semi-custom basic due to the wide range of size combinations and types of units required. For example it is not uncommon for a building such as a home to have many different size windows from large picture windows to small bathroom windows, and the types of windows can be large single pane picture windows, double hung windows and casement windows. It is according important that the manufacturing method be readily adapted to make different sizes and types of building units.

Another important factor to be considered with respect to metal building units is the thermal performance in use as compared to wooden frame windows. Wood has many problems such high maintenance and limited durability, but wood is inherently a very good thermal insulator and therefore prevents thermal transfer through the frame. Most metal building units are made with extruded aluminum frames. Aluminum, and other metals, unlike wood, are poor thermal insulators. Accordingly the problem of transfer of heat and resulting "sweating" of metal frames must be taken into consideration.

A further important factor to be considered with respect to metal building units is short term and long term mechanical stability. The metal building units such as windows are assembled in a factory with glass panels held in place by the metal frames. The assembled units must be able to be shipped to the job site and installed without coming apart. Once a window is installed the frame holds the glass in place during use. Considerable positive and negative force is applied to the installed windows panes by wind on the exterior side. The force applied to the window panes is transferred to and carried by the window frame. The window frames must be sufficiently strong so as not to come apart and allow the window panes to become loose or fall out. The metal frames must maintain their structural integrity over the useful life of the metal building unit which can be many years.

When metal buildings units such as windows were first introduced the frames were made with one piece metal extrusions which formed the interior and exterior portions of the frames. The single piece frames had adequate strength properties but were found to be unsatisfactory because of heat transfer though the frame and moisture and frost forming on the frames. It was suggested to make the frames with separate inner and outer sections to limit the thermal transfer. The multipart units were unsatisfactory as they were much more difficult assemble and install properly as the inner and outer portions had to be separately installed.

To overcome the problems of the separated multi-part units it was suggested to connect the exterior and interior sections with a section called a "thermal break" made of a material having low heat conductivity such as low heat conductive plastic. The thermal break has the dual function of thermally isolating the inner section from the outer section of the frame and holding the sections together so the building unit can be installed as a unit.

The methods which were hereto suggested for forming the thermal break were far from satisfactory. The methods were complex and time consuming resulting in a substantial increase in production time and cost. One such method is disclosed in Hetman, U.S. Pat. No. 3,099,337, where is it suggested to force an oversized strip of a thermal insulating material endwise into one section of the metal frame using the end of the section of a metal frame to shape the strip to size and then forcing a second section of the metal frame into a groove formed in the thermally insulating material. This method was unsatisfactory because it was found difficult to end wise force feed the sections together, particularly if the sections were relative long. In addition the assembled frames did not have the required mechanical strength as the sections rotated in use and tended release the sealing pressure on the window panes.

A further suggestion to make metal frames having an inner and outer sections separated with a thermal break was disclosed in Burbank, U.S. Pat. No. 4,704,839 and in Rawling, U.S. Pat. No. 5,187,876. According to these patents a one piece extruded metal section is formed with a pocket in the center web. A curable liquid resin, such as a polyurethane, is then inserted in the pocket and allowed to cure. After the resin has cured an elongated strip of metal is machined away to separate the starting single section into two separate sections, thermally isolated, but secured together by the cured resin.

In Hetman, U.S. Pat. No. 4,067,163 there is disclosed an improved method for forming a molded in place thermal break. The improvement disclosed by Hetman '163 is to apply a release agent before forming the cast in place thermal block to inhibit the adhesive bonding of the thermal break and the metal parts and thereby that avoid destructive forces in the thermal break section due to differences in thermal expansion and contraction of the inner and outer metal sections.

The methods of forming the thermal breaks in place as suggested by Burbank, Rawling and Hetman described above all have certain inherent problems. The casting of the liquid resin in place is a costly and time-consuming process. The required accurate mixing of the components of resin presents problems in commercial production. Also the requirement of post machining the starting metal part into two sections adds to the manufacturing cost. The most serious problem, however, encountered with the above described prior art methods is that the cast in place thermal breaks have been found to mechanically and chemically break down in a relatively short period of time. Since it is the thermal break which holds the exterior and the interior metal sections together, when the thermal break fails, the window fails, literally falling apart and resulting in a very dangerous condition.

The exact reason for the failure of the materials used for the cast in place thermal breaks is not known. It is believed however that the cast-in-place polyurethanes typically used in this application do not have adequate long term properties to withstand the conditions encountered in extended exposure to the elements. The exterior side of a window can reach temperatures as high as 180 degrees Fahrenheit with dark colored exterior frames in the summer and as low as 30 to 40 below zero Fahrenheit in the winter. If the thermal break is bonded to the metal portions the difference in the expansion and contraction of the inside portions of the window, the outside portion of the window and the thermal break can mechanically fracture the resin. A further problem is that the cast-in-place resins in general and the polyurethane resins in particular do not have the required long term chemical stability due to thermal cycling and hydrolysis.

The problem of failure of the thermal breaks is a long standing, well known, problem in the art. The suggestions heretofore made to correct this problem have at best been stop gap measures or compromises. Coulston, U.S. Pat. No. 4,377,926 (1983) clearly recognized the problem of failure of the thermal breaks and suggested using metal sections, one of which has a pocket, the other of which has a tee shaped extension which is positioned in a locking relationship in the pocket of the other metal part. The resinous thermal break is cast in place in the pocket to separate the metal parts. If the resinous thermal break fails the metal parts will become loose but will be held together by the tee shaped extension in engagement with the pocket to provide what is referred to as a "fail safe" window. This suggestion does not however correct the underlying problem of failure of the thermal breaks and presents problems in holding tolerances in manufacturing.

An alternate suggestion to make a "fail safe window" was disclosed in Meigs et al., U.S. Pat. No. 4.423,578 (1984). In Meigs et al. was suggested to remove only portions of the metal strip between the inner and outer sections rather than completely removing the metal strip as noted above. This method is referred to as "skip-debridge." The remaining metal portions in the strip hold the inner and outer metal sections together if the thermal break fails. This however is at best a compromise in that it partially defeats the purpose of having a thermal break as heat and cooling are transferred through the remaining metal portions. In addition this method has been found to increase buckling of the metal parts as a result of heat transfer across the remaining metal portions in the separation strip.

In Hetman, U.S. Pat. No. 3,289,377, it was suggested to use an extruded thermal plastic strip as the thermal break. According to Hetman '377 the strip was first molded to shape and then post formed by stretching to reduce it size. The strip was then inserted in the frame and had to be heated to return the strip to its original shape. In practice the method was found to be too cumbersome for commercial production and the results were not dependable.

The problem of assembling windows having thermal breaks to prevent heat transfer through the metal window frames and providing rigid assemble is also addressed in the foreign prior but the problem still exists. For example, in Swiss patent number 420 567 issued Sep. 15, 1964 a method is disclosed wherein one metal section is formed with a dove tail shaped extension which fits into a mating grove in a thermal break section. The thermal break section in turn is fitted into a second metal section. The specific method used employs a second extruded metal section that as formed has a wall which is bent out of position to allow the thermal break section to be installed in the open channel of the second section. After the assembly is completed, the bent out wall is forced back into position to hold the thermal break in place. The method in the Swiss is unsatisfactory in commercial production in that post forming of the metal section is difficult because it is deep within the assembled window and requires a separate step in the assemble process. Also, the required roll forming of the bent out wall causes the extrusion to bow, making it unstable. Furthermore, in order to securely hold the thermal break in position, the thermal break section has to be some what resilient rather than rigid which detracts from the mechanical stability of the assembled window. The disclosed dovetail likewise is insufficient in width which further adds to the instability of the final window.

What would be highly desirable would be a metal building unit such as a window having an exterior metal portion, an interior metal portion and a thermal break which is easy and inexpensive to assemble, has an effective thermal break, can have different finishes on the interior and exterior metal surfaces and which has short term and long term mechanical and chemical stability.

SUMMARY OF THE INVENTION

In accordance with this invention a composite frame member is provided which is comprised of a first metal section, a second metal section and a preformed thermal break section. The first metal section has a longitudinal inner channel. The second metal section has an extension positioned within the channel of the first section in a predetermined spaced apart relationship from the first metal section. The composite metal frame member is assembled by inserting the thermal break section laterally into the channel of the first metal frame section and then inserting the second metal frame section laterally into the channel in the thermal break section. The dimensions of the respective sections are selected so the sections snap lock together.

BRIEF DESCRIPTION BRIEF DESCRIPTION OF THE DRAWING

DETAILED DESCRIPTION OF THE PREFERRED EMBODIMENTS

Figure 1:
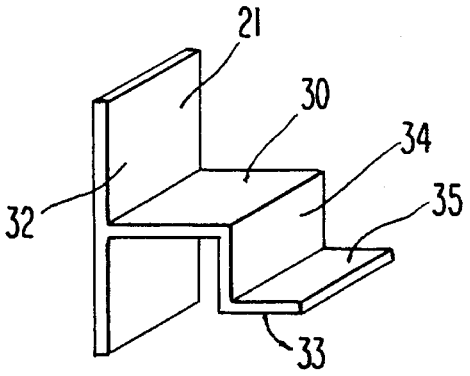
FIG. 1 is an illustration in perspective of the second metal section of the metal frame member of this invention.
Figure 2:
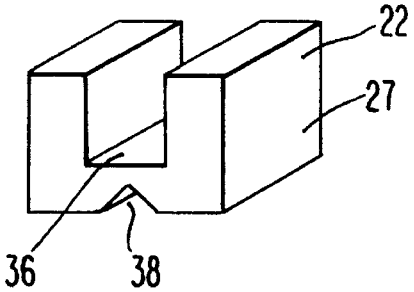
FIG. 2 is an illustration in perspective of the preformed thermal insulation section of this invention.
Figure 3:
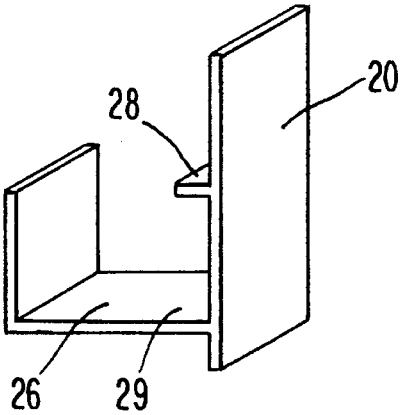
FIG. 3 is an illustration in perspective of the first metal section of the metal frame member of this invention.

Referring now in more detail to the drawings, in which like numbers indicate like elements throughout the figures, in FIGS. 1, 2, and 3 there is shown the three sections 20, 21, 22 which when assembled together form the composite frame member 24 of this invention. The three sections include a first metal section 20, a second metal section 21 and a thermal break section 22.

The first metal section 20 and the second metal section 21 are preferable formed of aluminum because of it easy extrudability, relatively low cost, light weight and excellent corrosion resistance. Other metals such as steel can also be used to form the metal sections 20, 21.

The thermal break section 22 is extrusion molded of a material which has thermal insulating properties in that it is this section 22 which spaces and insulates the first and second metal sections 20, 21 from each other and thereby prevent the transfer of heat and cooling between the first and second metal sections 20, 21. The materials used for the extruded thermal break section 22 have sufficent rigidity and compressive strength to securely holds the first and second sections 20, 21 together to form the frame member 24. In addition it is highly desirable if the material used for the thermal break section 22 be somewhat resilient as it assists in the assembly of the frame member 24 and locking the sections 20, 21, and 22 together. Its important however that the extruded plastic be sufficiently rigid that the metal sections 20, 21 snap lock together with and be held in position by the thermal break 22. Soft, highly deformable materials such as rubbers commonly used for seals and gaskets are unsuitable as they will deform and allow the individual sections to separate when force is applied to the window panes held by the frame. Last but not least the material used for the thermal break 22 should have long term chemical and mechanical stability under the weather conditions anticipated to be encountered in use of the frame member 24. There are a number of well known materials which are suitable for molding the thermal break 22. A material which has been found to be particularly suitable is polyvinylchloride in that it is relative inexpensive and can be formulated into compositions having proven long range stability under the conditions the metal frame member 24 will be subjected to in use. The well known proven compositions of polyvinylchloride used for the manufacture of vinyl siding, shutters and similar other products which are exposed to the weather are well suited for the manufacture of the thermal break section 22. These compositions typical contain polyvinylchloride, an inert filler such as calcium carbonate and additives including antioxidants and ultraviolet protector. Other materials which are suitable are polycarbonate resins and compositions, polyolifins, polyesters, polyamides, ABS and the like. When manufacturing long sections of the the thermal break 22 this is preferable done by extrusion molding with above noted materials. If however short thermal break sections are used, as will be explained below in greater detail, the thermal break sections can be molded by injection molding or extrusion molding. Injection molding is relative inexpensive and recycled materials are readily used in this method. Compression molding on the other hand can be used to mold short thermal break section from high performance composition such fiberglass reinforced epoxy resin composition for use in specialized applications.

The cross sectional shape of the extruded metal sections 20, 21 can be varied considerably, provided that when assembled together the combination of the first metal section 20, the thermal break section 22 and the second metal section 21 lock together to form a frame member 24 suitable for receiving and holding an insulated window pane 25 or the like.

The first metal section 20 has an inner channel 26 extending longitudinally along the length of the first metal section 20. The inner dimensions of the channel 26 are selected so that the channel 26 substantially mates with the outer cross sectional shape 27 of the thermal break section 22. As illustrated the first metal section 20 includes an optional locking extension 28 which is located above the base 29 of the inner channel 26 a distance which is equivalent to the height of the side 30 of the thermal break section 22. As will be explained below the extension 28 is use to lock the thermal break section 22 in the channel 26 of the first metal section 20.

The second metal section 21, like the first metal section 20, can be formed with various cross sections. As shown in FIG. 1, the second metal section 21 has extension 20 31 projecting from the outer wall portion 32 of the second metal section 21. The extension 31 includes an ell shaped locking foot 33. The ell shaped locking foot 33 is comprised of a vertical section 34 and a horizontal section 35 which are sized to fit in a locking relationship in the channel 36 of the thermal break section 22.

The cross sectional shapes of first metal section 20 and the second metal section 21 are selected so that the extension 31 of the second metal section 21 can be inserted in a spaced apart relationship in the channel 26 of the first metal section 20 and held in that spaced apart relationship by the thermal break section 22.

The cross sectional shape of the thermal break section 22 corresponds to the shape of the first and second metal sections 20, 21. As shown in FIG. 2 the thermal break section 22 has a wall 37 of uniform thickness to provided uniform thermal insulation of the first metal section 20 from the second metal section 21. The outer cross sectional shape 27 of the thermal break section 22 is shaped to mate with the channel 26 of the first metal section 20. The channel 36 in the thermal break 22 is shaped to receive and lock in place the extension 30 of the second metal section 21. An optional vee groove 38 is formed in the thermal break section 22 to impart additional flexibility to the thermal break section 22 in order to simplify the insertion and to hold it in place in the first metal section 20.

Figure 4:
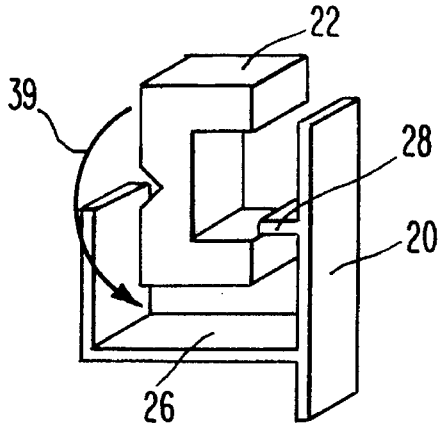
FIG. 4 is an illustration in perspective showing the lateral and rotational insertion of the thermal break section into the first metal section.
Figure 5:
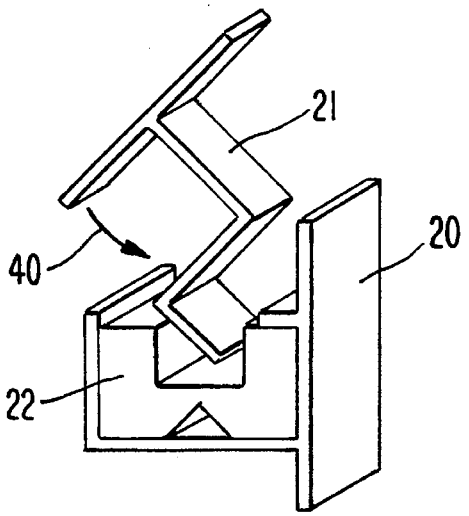
FIG. 5 is an illustration in perspective showing the lateral and rotational insertion of the second metal section into the thermal break section.

An important advantage of the present invention is the method used to assemble the composite frame member 24. As shown in FIG. 4, the first step is to insert the thermal break section 22 into the channel 26 of the first metal section 20. As illustrated, the thermal break section is inserted at a right angle to it final position in order to allow it to pass the locking extension 28 of the first metal section 20. It is then rotated counterclockwise as indicated by the arrow 39 into position in the channel 26 as shown in FIG. 5. In a less preferred alternate embodiment (not shown) the locking extension 28 is omitted and the thermal break section 22 can be inserted directly into the channel 26 of the first metal section 20.

In the second step of the assembly as shown in FIG. 5 the ell shaped locking foot 33 of the second metal section 21 is inserted into the channel 36 of the thermal break section 22 and rotated into position as indicated by the arrow 40. The horizontal portion 35 of the ell shaped locking foot 33 of the second metal section 21 has a width which is the same as or slightly larger than the width of the channel 36 which causes it to snap lock into in position within the channel 36 of the thermal break section 22.

The method used to assemble the composite window frame of the invention 24 has many advantages in comparison the methods used in the prior art. The method only requires two relative simple steps to completed the frame. This should be compared to the prior methods wherein a resin is cast in place followed by a expensive machining step to separate the metal starting extrusion into two sections to form a thermal break. Furthermore since the thermal break section 22 of this invention is preformed by extrusion molding or the like it can readily be formed of compositions known have the required mechanical and chemical stability for long term use.

Figure 6:
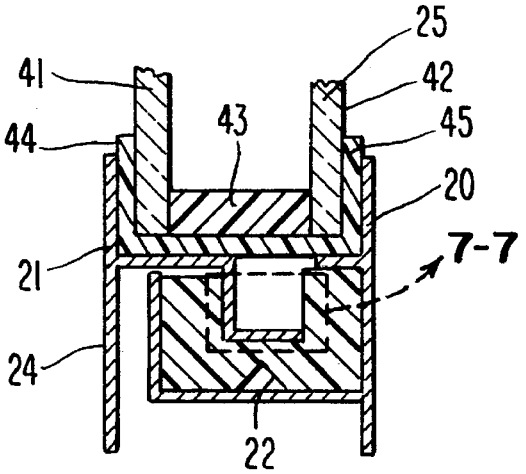
FIG. 6 is an end view of the assembled metal frame member of this invention shown in combination with a double pane insulated window.

In FIG. 6 a fully assembled composite frame member 24 is shown in combination with a double pane insulated window 25. As can be seen in FIG. 6 the first metal section 20 and the second metal section 21 are held in a spaced apart relationship by the thermal break section 22. The insulated double window pane 25 is comprised of an outer pane 41, an inner pane 42 and a seal 43 which provides an insulating gap between the panes 41, 42. The insulated window pane 25 is shown positioned in a receiving channel 44 formed by the assembled sections 20, 21 and 22. The insulated window pane 25 is sealed in position with a marine glazing gasket 45. Optional caulking 47 can be placed in the channel 36 in the thermal break to further seal the insulated window pane 25.

In use it important that the composite frame member 24 securely hold the insulated window pane 25 in place and not allow it to separate into its individual sections. Force is applied in use to the insulated pane 25 by wind pressure. The combination of the first section 20, the second section 21 and the thermal break section 22 in accordance with this invention has the required structural strength required for most applications. If desired, however, the sections 20, 21, 22 can be further secured together with the use of locking extensions 28, detents and the like.

Figure 7:
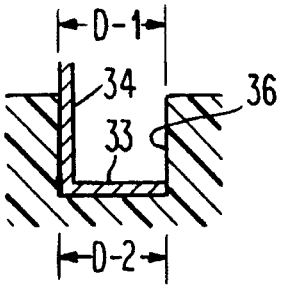
FIG. 7 is an illustration taken as indicated by the lines and arrow 7—7 on FIG. 6 showing the interlocking relationship of the first metal section and the thermal break section.
Figure 8:
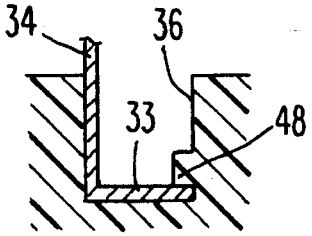
FIG. 8 is an alternate embodiment of the locking arrangement show in FIG. 7 which includes a locking extension on the thermal break section.

In FIGS. 7 to 11 various alternate structures are shown for providing locking the of second metal section 21 in position in the channel 36 of the thermal break section 22. In FIG. 7 the width d-1 of the channel 36 is slightly less than the width d-2 of the ell shaped locking foot 33 so that there is a force fit of the locking foot 33 in the channel 36. In FIG. 8 the thermal break section 22 is shown formed with a longitudinal extension 48 under which the ell shaped locking foot 33 is locked in position.

Figure 9:
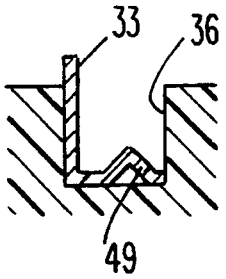
FIG. 9 is an additional alternate embodiment of the locking arrangement of FIG. 7 wherein the first metal section includes a vee shaped biasing mean for locking the first metal section and the thermal break section in engagement.
Figure 10:
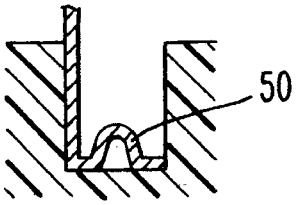
FIG. 10 is an alternate embodiment of the structure shown in FIG. 9 where an arcuate spring member is incorporated in the second metal section to lock the first metal section and the thermal break section in engagement.

In FIG. 9 the ell shaped locking foot 33 has an integral biasing spring 49 which is compressed as the second metal section 21 is inserted into the channel 36 and expands to lock the second metal section 21 in place. An alternative type of spring is shown in FIG. 10 wherein the spring section 50 is arcuate. The spring section 50 compresses during installation and expands when in place to hold the second metal section 21 in position within the channel 36 of the thermal break section 21.

Figure 11:
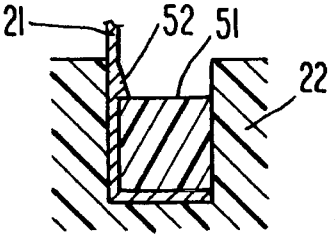
FIG. 11 is a further alternate embodiment of FIG. 7 wherein a locking member comprised of a strip of thermal insulation is inserted the channel of the first section to prevent relative movement of the first metal section and the thermal break section.
Figure 12:
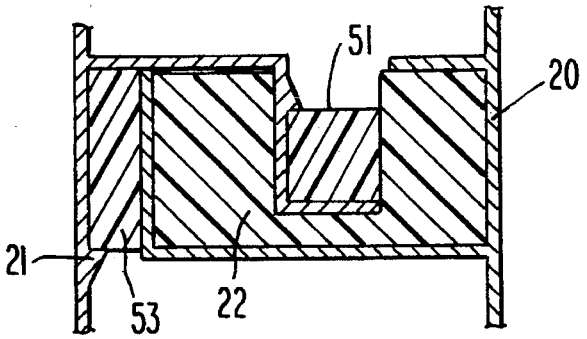
FIG. 12 is a further alternate embodiment of the structure of FIG. 11 having an additional locking strip of a thermal insulation material inserted between the first and second metal section to prevent separation of the metal sections.

In FIGS. 11 and 12 further structures are illustrated where the sections 20, 21 and 22 are locked together with the use of a locking strip 51. The strip 51 is preferably extruded from the same insulating material as the thermal block section 22. The locking strip 51 is forced laterally into the channel 36 and is held in place with a detent 52 on the second metal section 21. The locking strip 51 prevents the rotation of the second metal section 21 and thereby prevents the frame member 24 from coming apart in use. A further alternative for insuring the stability of the frame member 24 is shown in FIG. 12 where in addition to the locking strip 51 a second locking strip 53 is inserted between the first and second section 20, 21 as shown in the cross section in FIG. 12 and held in place with a detent 54 on the second metal section 21. Alternatively, the detent could be on section 20.

Figure 13:
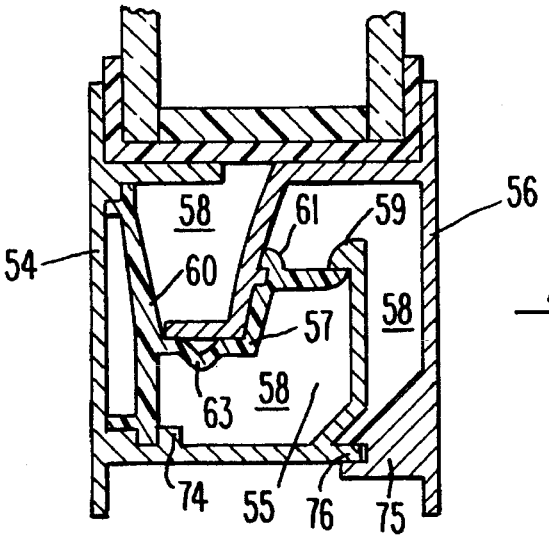
FIG. 13 is an illustration showing an alternate embodiment of this invention having an alternative cross sections for the first and second metal sections and the thermal break section.

In FIG. 13 there is shown an alternate embodiment of this invention comprised of sections corresponding to FIGS. 1 and 3 but with different cross sections. The first metal section 55 of this embodiment also has a channel 56 for receiving the second metal section 57 in a spaced apart relationship separated and insulated from each other by a thermal break section 58. The improvement shown in this embodiment is that the thermal break section 58 is not solid as previously shown but is formed as a spider. This embodiment has the advantage the of air gaps 59, 60, 61 between the spider thermal break section 58 and the first and second metal section 55, 57 which are more effective than solid material in thermally insulating the metal sections 55, 57 from each other. The embodiment shown in FIG. 13 is assembled by inserting the spider thermal break section 58 laterally and rotationally into the channel 56 of the first metal section 55 where it is held in position by the detents 62, 73 and 74 and the optional integral vee shaped spring section 63. The second metal section 57 is then inserted laterally and rotationally into a channel 64 of the spider thermal break section 58 and held in place with the detents 65 an 66. Wedge 75 engages a detent 76, preventing rotation of the first metal section and the second metal section 57 in relation to each other and holding vertical faces 77, 78 of the first and second metal section 55, 56 parallel to each other.

Figure 14:
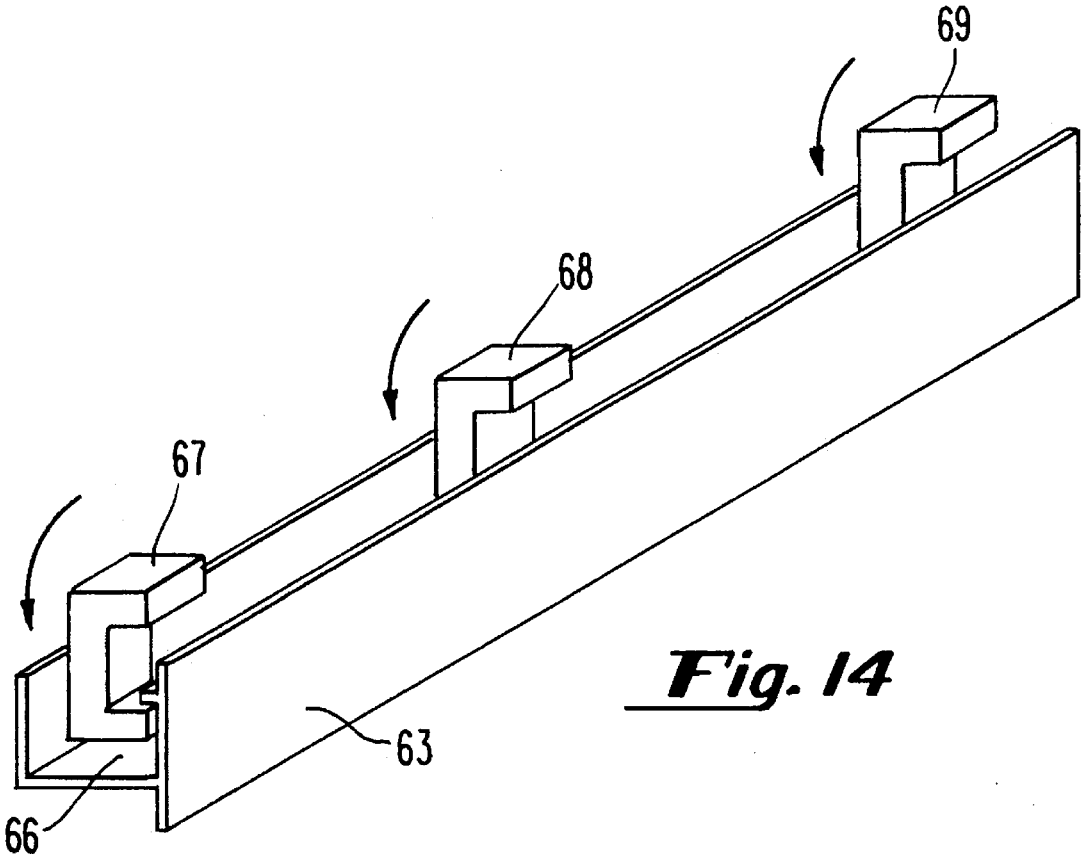
FIG. 14 is an illustration showing the initial assembly step where the thermal break section is comprised of separate spaced apart sections.
Figure 15:
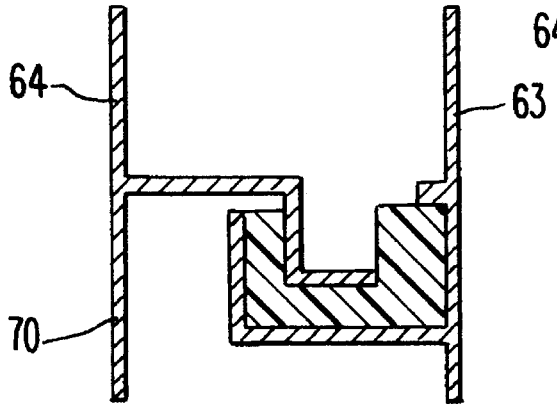
FIG. 15 is an illustration showing the cross section of an assembled frame of the embodiment of FIG. 14 at the location where the thermal break sections are present.
Figure 16:
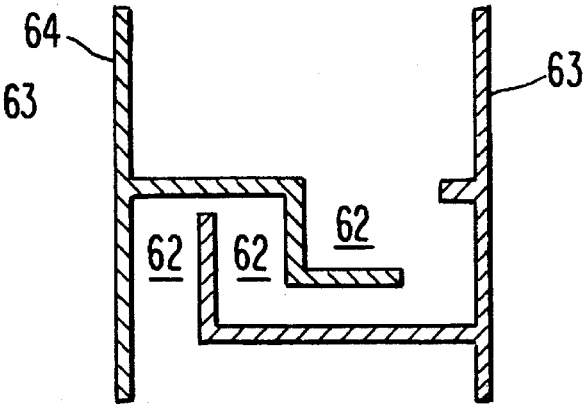
FIG. 16 is a illustration showing the cross section of the completed assembly of FIG. 14 shown at location where there no thermal break sections showing the spaced apart relationship of the first and second metal sections.

In FIG. 14, 15, and 16 there is shown a still further preferred embodiment of this invention in which an air gap 72 is used to insulated the first and second metal sections 20, 21 from each other. For purposes of this illustration the first and second metal sections 20, 21 as shown are identical to the first and second metal section 20, 21 of the embodiment of FIG. 5. It is of course possible to use metal sections with other cross sections such as those shown in FIG. 13. The improvement in this embodiment is that the thermal block is inserted longitudinally along the channel of the first member 20 in a series of spaced apart individual sections 67, 68, 69. The second member 21 is then inserted laterally and/or rotationally into the thermal break sections 67, 68, 69. The cross section of the assembled frame at the locations 70 where the sections of the thermal blocks 67, 68, 69 are present is shown in FIG. 15 and is the same as the embodiment shown in FIG. 4, However at the locations 71 between the thermal block sections 67, 68, 69, 69 an air gap 72 is the effective thermal insulation as shown in FIG. 16. This embodiment has a number of advantages in comparison the other embodiments heretofore described. Initially the thermal block sections do not have to be custom cut to length when making a frame member but rather are preformed by extrusion, injection or compression molding in uniform length short sections 67, 68, 69 which can be used with various lengths of metal sections. The short thermal block sections are simpler to install than the full length sections and reduce assemble time. The material cost are also lower than when using continuous lengths of thermal break sections. The most important advantage, however, is that the air gap 72 provides the most effective thermal insulation at the least material cost.

The present invention has been with described with reference to several different embodiments. It should be appreciated that other embodiments which would be obvious after having been made aware of the disclosure are included within the scope of this invention and the subjoined claims.

What is claimed is:

1. A thermally insulated architectural frame member comprised of an elongated first metal section, an elongated second metal frame section and a preformed thermal break section; said first metal member having a longitudinal first outer wall and an extension extending laterally and inwardly from the outer wall thereof which in combination with the outer wall forms a first channel of a first predetermined cross sectional shape; the second metal frame section having a second outer wall portion and an integral extension extending laterally and inwardly from the second outer wall portion of a second predetermined cross sectional configuration including a generally ell shaped locking foot; said first and second predetermined cross sectional shapes being selected so that when the first and second metal sections are in an opposing relationship the ell shaped locking foot of the second metal section can be inserted into the channel of the first metal section in a spaced apart relationship; said preformed thermal break section being preformed from a rigid material having a low thermal conductivity as compared to metal and having an outer wall substantially mating the cross section of the channel of the first metal section and including a second channel for receiving the ell shaped locking foot in locking engagement spaced apart from the outer wall of the thermal break section; said thermal break section being positioned within the channel of the first metal section and said second metal section being positioned in an opposing relationship to the first metal section with the ell shaped locking foot engaged with the second channel in the thermal break section whereby the first metal section and the second metal section are mechanically secured together and thermally insulated from each other by the thermal break section and wherein the thermal break section includes a means opposing the second channel to allow the thermal break member to flex during insertion of the thermal break section into the first channel in the first metal section.

2. The frame member according to claim 1 wherein the the thermal break section is laterally and rotationally insertable into the first metal section and the second metal member is laterally and rotationally insertable into the thermal break section.

3. The frame member according to claim 1 where the thermal break section is comprised of an extrusion molded plastic.

4. The frame member according to claim 1 wherein the thermal break section is molded from a polyvinylchloride composition having long term weathering resistant.

5. The frame member according to claim 1 wherein ell shaped locking foot of the second metal section is sized to snap lock in place when longitudinally inserted into the second channel of the thermal break section.

6. A thermally insulated architectural frame member comprised of an elongated first metal section, an elongated second metal frame section and a preformed thermal break section; said first metal member having a longitudinal first outer wall and an extension extending laterally and inwardly from the outer wall thereof which in combination with the outer wall forms a first channel of a first predetermined cross sectional shape; the second metal frame section having a second outer wall portion and an integral extension extending laterally and inwardly from the second outer wall portion of a second predetermined cross sectional configuration including a generally ell shaped locking foot; said first and second predetermined cross sectional shapes being selected so that when the first and second metal sections are in an opposing relationship the ell shaped locking foot of the second metal section can be inserted into the channel of the first metal section in a spaced apart relationship; said preformed thermal break section being preformed from a rigid material having a low thermal conductivity as compared to metal and having an outer wall substantially mating the cross section of the channel of the first metal section and including a second channel for receiving the ell shaped locking foot in locking engagement spaced apart from the outer wall of the thermal break section; said thermal break section being positioned within the channel of the first metal section and said second metal section being positioned in an opposing relationship to the first metal section with the ell shaped locking foot engaged with the second channel in the thermal break section whereby the first metal section and the second metal section are mechanically secured together and thermally insulated from each other by the thermal break section and wherein the ell shaped locking foot includes vertical and horizontal elements which together substantially conform to the interior of the second channel and wherein the horizontal element of the locking foot is wider than the width of the second channel by an amount sufficient to cause the locking foot to snap lock in place within the second channel.

7. The frame member according to claim 6 wherein the horizontal element includes a spring biasing means allowing the horizontal element to be compressed during installation and to expand to hold the second metal section in engagement with the thermal break section.

8. The frame member according to claim 7 wherein the spring biasing means is an inverted vee shaped portion of the horizontal element of the ell shaped locking foot.

9. The frame member according to claim 7 wherein the spring biasing means is arcuate shaped portion of the horizontal element of the ell shaped locking foot.

* * * * *